US005494116A

United States Patent [19]

Wentworth

[11] Patent Number: 5,494,116

[45] Date of Patent: Feb. 27, 1996

[54] PNEUMATIC IMPACT TOOL FOR PIPE INSERTION

[75] Inventor: Steven W. Wentworth, Brookfield, Wis.

[73] Assignee: Earth Tool Corporation, Oconomowoc, Wis.

[21] Appl. No.: 192,010

[22] Filed: Feb. 4, 1994

[51] Int. Cl.[6] ..... B25D 9/04

[52] U.S. Cl. ..... 173/17; 173/91; 173/206; 175/296

[58] Field of Search ..... 173/13, 15, 17, 173/91, 128, 131, 132, 133, 206; 175/296; 405/154, 184

[56] References Cited

U.S. PATENT DOCUMENTS

| | | | |
|---|---|---|---|
| 2,403,582 | 7/1946 | Caudill | 173/131 |
| 2,622,562 | 12/1952 | Longenecker | 173/133 |
| 3,407,884 | 4/1967 | Zygmunt et al. | 173/91 |
| 3,827,507 | 8/1974 | Lance et al. | 173/15 |
| 3,866,690 | 2/1975 | Lance et al. | 173/15 |
| 3,924,690 | 12/1975 | Shaw | 173/13 |
| 4,067,200 | 1/1978 | Watts, Jr. et al. | 61/72.5 |
| 4,329,077 | 5/1982 | Bouplon | 403/287 |
| 4,650,374 | 3/1987 | Schmidt | 405/184 |
| 4,671,703 | 6/1987 | Schmidt | 405/184 |
| 5,025,868 | 6/1991 | Wentworth | 173/91 |
| 5,199,151 | 4/1993 | Wentworth | 29/437 |

OTHER PUBLICATIONS

Total Quality Systems, TT Technologies, 1991 at pp. 13–15.

*Primary Examiner*—Rinaldi I. Rada
*Assistant Examiner*—Jay A. Stelacone
*Attorney, Agent, or Firm*—Foley & Lardner

[57] ABSTRACT

A pneumatic impact tool useful in pipe insertion operations has a simplified construction as compared to the pneumatic ground piercing tools currently in use for such operations. The body of the tool is a thin walled sleeve clamped between a nose section and an end plate by one or more tying devices such as rigid metal tie rods. This eliminates the need for a thick walled tool body having a tapered nose as is common in existing tools made to move through the soil.

12 Claims, 3 Drawing Sheets

PNEUMATIC IMPACT TOOL FOR PIPE INSERTION

TECHNICAL FIELD

This invention relates to pneumatic impact tools, particularly to a tool designed for insertion of pipes into the ground.

BACKGROUND OF THE INVENTION

Self-propelled pneumatic tools for making small diameter holes through soil are well known. Such tools are used to form holes for pipes or cables beneath roadways without need for digging a trench across the roadway. These tools include, as general components, a torpedo-shaped body having a tapered nose and an open rear end, an air supply hose which enters the rear of the tool and connects it to an air compressor, a piston or striker disposed for reciprocal movement within the tool, and an air distributing mechanism for causing the striker to move rapidly back and forth. The striker impacts against the front wall (anvil) of the interior of the tool body, causing the tool to move violently forward into the soil. The friction between the outside of the tool body and the surrounding soil tends to hold the tool in place as the striker moves back for another blow, resulting in incremental forward movement through the soil. Exhaust passages are provided in the tail assembly of the tool to allow spent compressed air to escape into the atmosphere.

Most impact boring tools of this type have a valveless air distributing mechanism which utilizes a stepped air inlet. See, for example, Wentworth et al. U.S. Pat. Nos. 5,025,868 and 5,199,151. The step of the air inlet is in sliding, sealing contact with a tubular cavity in the rear of the striker. The striker has radial passages through the tubular wall surrounding this cavity, and an outer bearing surface of enlarged diameter at the rear end of the striker. This bearing surface engages the inner surface of the tool body.

Air fed into the tool enters the cavity in the striker through the air inlet, creating a constant pressure which urges the striker forward. When the striker has moved forward sufficiently far so that the radial passages clear the front end of the step, compressed air enters the space between the striker and the body ahead of the bearing surface at the rear of the striker. Since the cross-sectional area of the front of the striker is greater than the cross-sectional area of its rear cavity, the net force exerted by the compressed air now urges the striker backwards instead of forwards. This generally happens just after the striker has imparted a blow to the anvil at the front of the tool.

As the striker moves rearwardly, the radial holes pass back over the step and isolate the front chamber of the tool from the compressed air supply. The momentum of the striker carries it rearwardly until the radial holes clear the rear end of the step. At this time the pressure in the front chamber is relieved because the air therein rushes out through the radial holes and passes through exhaust passages at the rear of the tool into the atmosphere. The pressure in the rear cavity of the striker, which defines a constant pressure chamber together with the stepped air inlet, then causes the striker to move forwardly again, and the cycle is repeated.

These tools have been made reversible by providing a threaded connection between the air inlet sleeve and the surrounding structure which holds the air inlet concentric with the tool body. The threaded connection allows the operator to rotate the air supply hose and thereby displace the stepped air inlet rearwardly relative to the striker. Since the stroke of the striker is determined by the position of the step, i.e., the positions at which the radial holes are uncovered, rearward displacement of the stepped air inlet causes the striker to hit against the tail nut at the rear of the tool instead of the front anvil, driving the tool rearwardly out of the hole.

Impact tools of this type have been used in the installation of underground pipes. One such method is described in Watts Jr. et al. U.S. Pat. No. 4,067,200, wherein a flexible duct is pulled along behind a soil penetrating device as it moves through the soil. This method works well for installation of lightweight flexible pipes, but is less effective when used on heavier steel pipes.

To install steel pipes, pneumatic impact tools of the general type shown in the foregoing patents have been used to push a pipe into the ground rather than pull it. A trench is dug in the direction of insertion, and the tool is positioned in the far end of the trench. An adapter is fitted over the tool nose and positioned in the pipe. The pipe is placed in the near end of the trench with its front end in engagement with the trench wall at the installation site. The tool is then operated to pound the pipe into the ground end first. As the pipe moves into the ground, the tool follows, moving along towards the near end of the trench. See generally Bouplon U.S. Pat. No. 4,329,077, Schmidt U.S. Pat. Nos. 4,671,703 and 4,650,374, and *Total Quality Systems,* TT Technologies, 1991 at pages 13–15.

When the pipe has been fully inserted, the tool is operated in reverse to disengage the tool from the adapter, and the adapter is then removed from inside the pipe. A second section of pipe is then welded to the exposed end of the first pipe, and the adapter and tool are reinserted into the far end of the second pipe section. The process is then repeated as many times as needed to complete the run.

Once the end of the first pipe has emerged at the target site at the end of the run, the tool and adapter are removed from the trench, and one end of the pipe is capped with a fitting including a high pressure nozzle. Soil inside the pipe is then removed by first flooding the interior of the pipe with water through the nozzle and then forcing the soil out using compressed air in a manner well known in the art.

SUMMARY OF THE INVENTION

The present invention provides a pneumatic impact tool useful in pipe insertion operations which has a simplified construction as compared to the pneumatic ground piercing tools currently in use for such operations. According to the invention, the body of the tool, normally the single largest and most expensive component of the tool, may be a thin walled sleeve or tube clamped between a nose section and an end cap by one or more tying devices. This eliminates the need for a thick walled tool body having a tapered nose as is common in existing tools made to move through the soil. Such a tool can be readily used in the foregoing pipe pushing method with greater ease due to the tool's reduced weight (the tool is about 30% lighter than a comparable tool with a conventional body), and can also be used inside of a full length expander in applications wherein both tool and expander would move through the ground in the manner of known pneumatic boring tools.

A pneumatic impact tool of the invention has a body including a tubular sleeve, a nose section fitted over a front end of the sleeve, an end cap in engagement with a rear end of the sleeve, and a tying device engaging the nose section and end cap for clamping the sleeve therebetween. A striker is disposed for reciprocation within the body to impart impacts to the nose section for driving the body forward. An air distributing mechanism, such as the known stepped bushing mechanism, causes reciprocation of the striker. A tail assembly mounted in a rear end opening of the body secures the striker and air distributing mechanism in the body. In a preferred embodiment, the tying devices are rigid metal tie rods, and the tool includes a reversing mechanism so that the tool can be readily disengaged from a collet or adapter after a pipe section has been inserted. These and other aspects of the invention are described in greater detail in the description which follows.

BRIEF DESCRIPTION OF THE DRAWING

The invention will hereafter be described with reference to the accompanying drawing, wherein like numerals denote like elements, and.

DETAILED DESCRIPTION OF PREFERRED EMBODIMENTS

Figures 1, 2, 3, 4, 5, 6, 7:
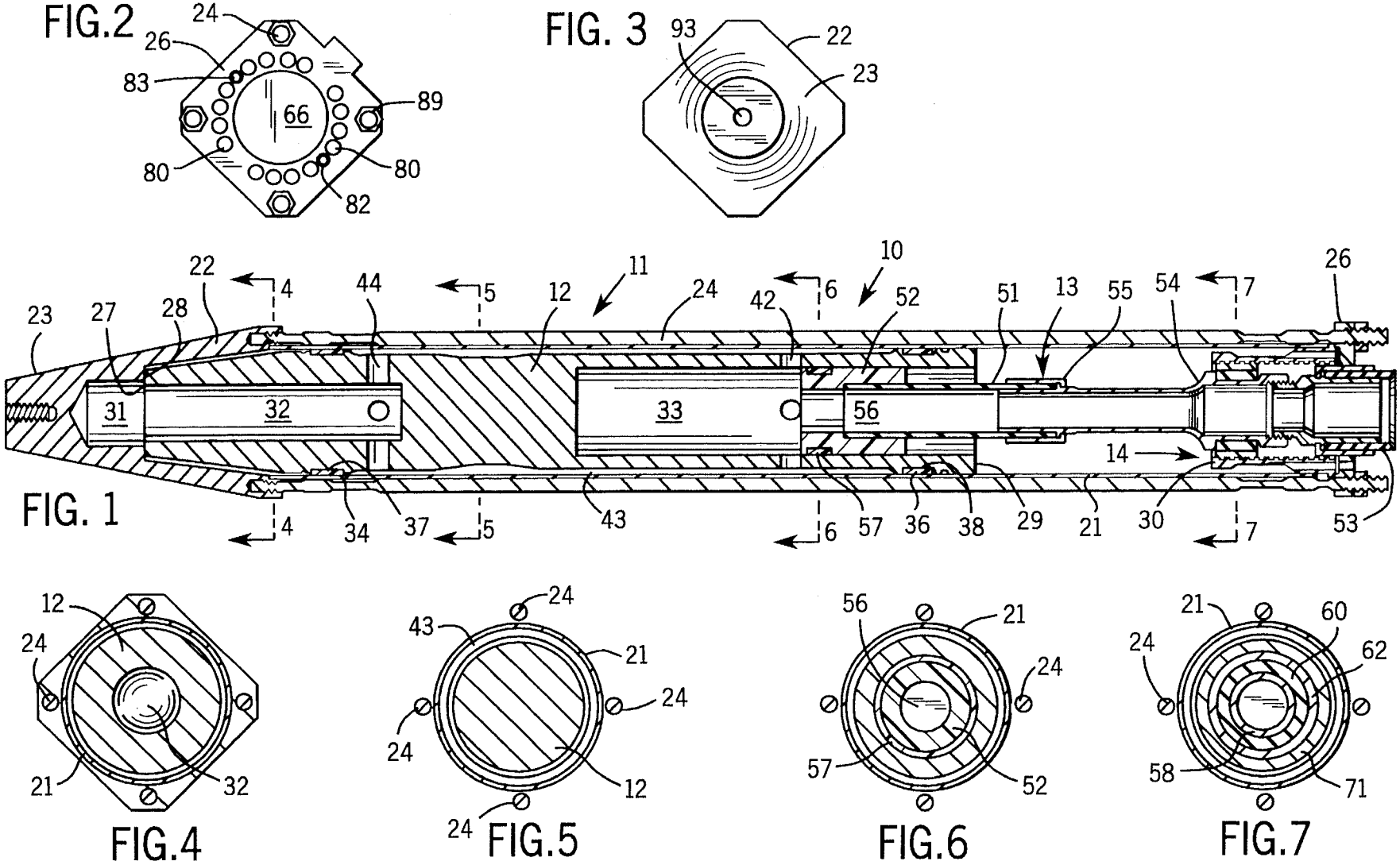
FIG. 1 is a lengthwise sectional view of an impact tool according to the invention.
FIG. 2 is a rear view, with the air hose omitted, of the tool shown in FIG. 1.
FIG. 3 is a front view of the tool shown in FIG. 1.
FIG. 4 is a cross-sectional view taken along the line 4—4 in FIG. 1.
FIG. 5 is a cross-sectional view taken along the line 5—5 in FIG. 1.
FIG. 6 is a cross-sectional view taken along the line 6—6 in FIG. 1.
FIG. 7 is a cross-sectional view taken along the line 7—7 in FIG. 1.

Referring now to FIGS. 1 to 7, a pneumatic impact tool 10 includes, as main components, a tool body 11, a striker 12 for impacting against the interior of body 11 to drive the tool forward, an air distributing mechanism in the form of a stepped air inlet conduit 13 which cooperates with striker 12 for supplying compressed air to reciprocate striker 12, and a tail assembly 14 which allows exhaust air to escape from the tool, secures conduit 13 to body 11, and provides a threaded connection with conduit 13 to allow reverse operation. Tool body 11 comprises a cylindrical, thin walled, tubular steel sleeve 21, a nose section in the form of a nose cone 22 having a forwardly tapered outer surface 23, a tying device in the form of rigid steel tie rods 24, and an end cap (plate) 26.

Striker 12 is disposed for sliding, back-and-forth movement inside of tool body 11 forwardly of conduit 13 and tail assembly 14. Striker 12 comprises a cylindrical rod having frontwardly and rearwardly opening blind holes (recesses) 32, 33 respectively therein. A pair of plastic, front and rear seal bearing rings 34, 36 are disposed in corresponding annular grooves 37, 38 in the outer periphery of striker 12 for supporting it for movement along the inner surface of sleeve 21.

An annular front impact surface 27 of striker 12 impacts against an annular step 28 on the inside of nose cone 22 when the tool is in forward mode, as shown in FIG. 1. An annular rear impact surface 29 impacts against the front end 30 of tail assembly 14 when the tool is in reverse mode. A rearwardly opening recess 31 located ahead of step 28 in nose cone 22 reduces pressure build-up during the forward stroke. An inner portion of impact surface 27 is inwardly offset from step 28 as shown to provide additional surface for initiating the rearward stroke of striker 12.

A number of rear radial holes 42 allow communication between recess 33 and an annular space 43 between striker 12 and sleeve 21 bounded by seal rings 34, 36. A second set of front radial holes 44 allow communication between space 43 and front recesses 31, 32. Annular space 43, holes 44, and recesses 31, 32 together comprise the front, variable pressure chamber of the tool.

Figure 8:
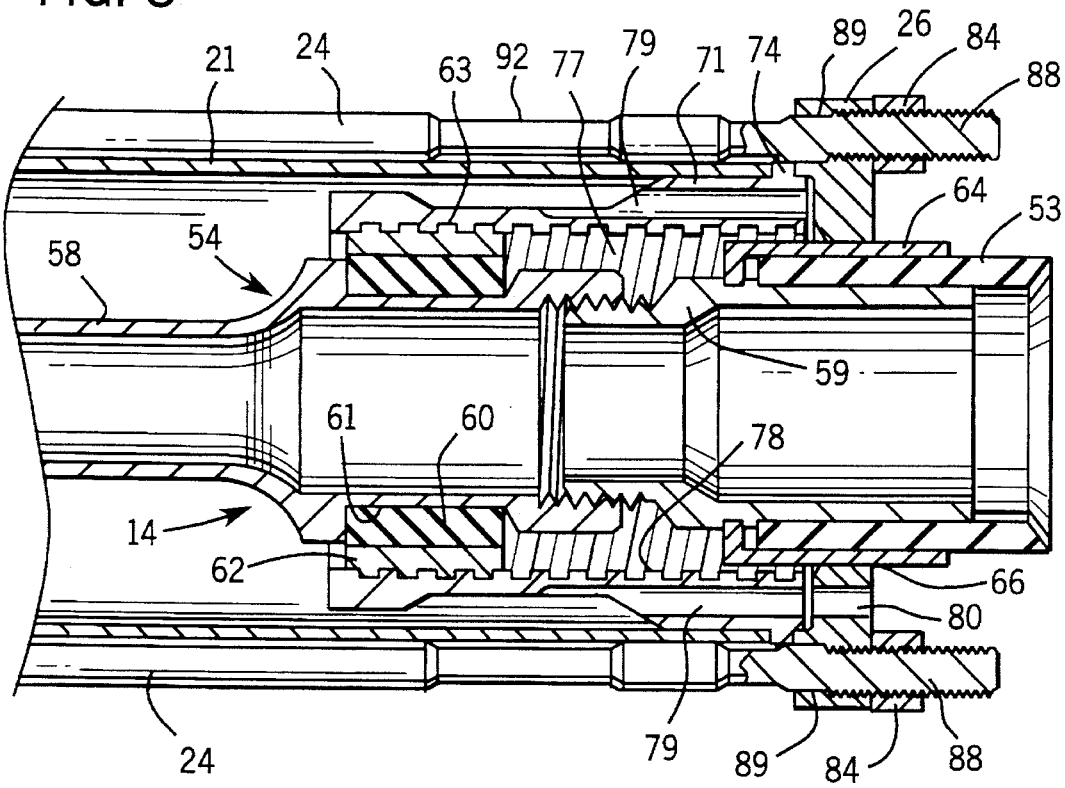
FIG. 8 is an enlarged sectional view of the rear end of the tool shown in FIG. 1.

Referring to FIGS. 1, 2 and 8, stepped air inlet conduit 13 includes a flexible hose 51, a tubular bushing 52, and an adjuster screw mechanism 54. Hose 51, which may be made of rubberized fabric, is secured by a coupling 55 to a front end portion of adjuster screw mechanism 54, which is in turn coupled to a further length of hose 53 which ultimately connects tool 10 with the air compressor. The inner end of hose 51 is adhesively bonded to the inner wall of bushing 52. An axial bore 56 which extends through adjuster screw mechanism 54, hose 51, and bushing 52 allows compressed air to pass from hose 53 through recess 33.

The cylindrical outer surface of bushing 52 is inserted into recess 33 in slidable, sealing engagement with the wall thereof. Recess 33 and the adjoining interior space of stepped conduit 13 together comprise a rear, constant pressure chamber which communicates intermittently with the front, variable pressure chamber by means of holes 42. Bushing 52 may, if needed, have a plastic bearing ring 57 disposed in an annular peripheral groove to reduce air leakage between bushing 52 and the wall of recess 33. Bushing 52 is preferably made of a light-weight material such as plastic.

Adjuster screw mechanism 54 includes front and rear sleeve sections 58, 59 which are threadedly coupled end-to-end as shown. This two-part construction facilitates assembly and disassembly of mechanism 54. An elastomeric shear coupling 60 is disposed in an annular groove 61 in the outer surface of front sleeve section 58 towards its rear end. An outer sleeve 62 is mounted on the outer periphery of shear coupling 60, which is preferably adhesively bonded to both sleeve 62 and groove 61. Outer sleeve 62 has external peripheral threads 63 for securing the stepped conduit 13 to tail assembly 14, as described further below. Outer sleeve 62 is made as short as possible, e.g., only about half or less the length of the threaded hole in which it is mounted. Sleeve 62 preferably is only long enough to provide enough screw thread turns to effect the operating mode change, such as about 6 or less. The rear end of rear section 59 of adjuster screw 54 has hose 53 secured thereto by a coupling 64 which extends together with hose 53 through a central hole 66 in plate 26.

Tail assembly 14 includes a tail nut 71 and end plate 26. Tail nut 71 has an exterior annular flange 74 which is clamped between plate 26 and the rear end of sleeve 21 inwardly from tie rods 24 to secure nut 71 to body 11. This eliminates the need to provide a threaded connection between body 11 and nut 71. Nut 71 further has a central hole 77 having screw threads 78 in engagement with threads 63 of sleeve 62. Threads 78 have blind front ends so that movement of sleeve 62 is limited to the forwardmost position shown in FIG. 8. Threads 78 open rearwardly so that air inlet conduit 13 can be unscrewed and removed from nut 71. The inner face of plate 26 limits rearward movement of sleeve 62 to a rearwardmost position so that sleeve 62 cannot become disengaged from nut 71 during operation.

Tail nut 71 is provided with lengthwise exhaust passages 79 which are in alignment with holes 80 extending through plate 26. Passages 79 and holes 80 are parallel to each other and to central hole 77, and are most advantageously arranged in a circular formation as shown in FIG. 2. Preferably, plate 26 also includes a pair of holes 82 having bolts 83 therein which are secured in aligned threaded holes (not shown) in tail nut 71. In this manner nut 71 can be clamp-loaded against plate 26.

Figure 9:
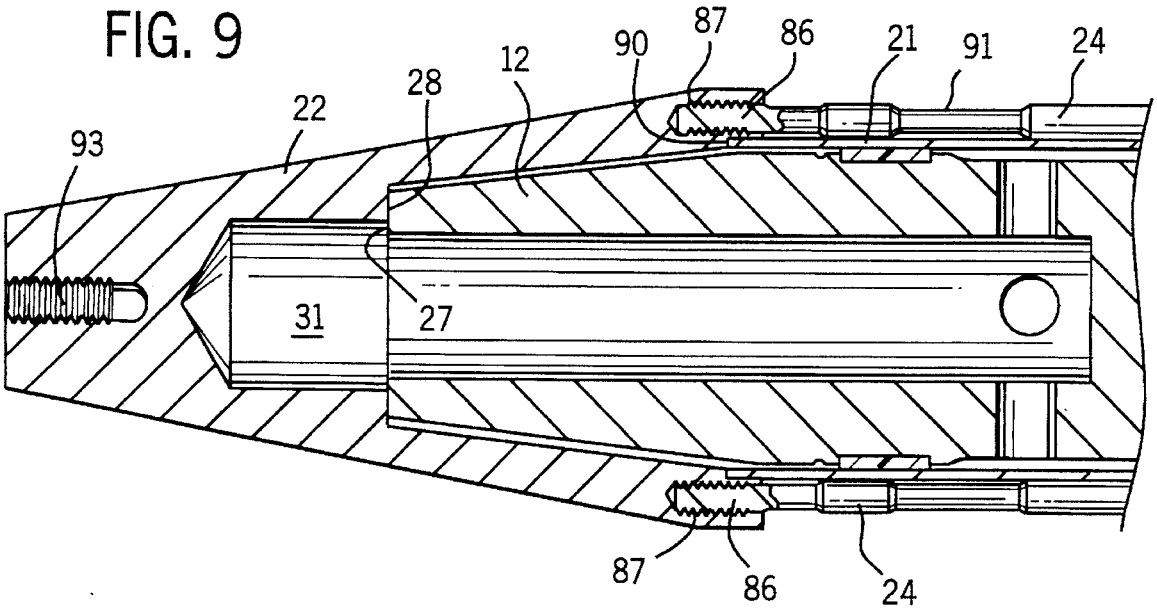
FIG. 9 is an enlarged sectional view of the front end of the tool shown in FIG. 1.

Referring to FIGS. 1, 8 and 9, threaded front ends 86 of tie rods 24 are secured in rearwardly opening threaded holes 87 in nose cone 22. Rear ends 88 of tie rods 24 are inserted through holes 89 in plate 26 located near the outer periphery of plate 26, i.e., radially outwardly of exhaust holes 80, which are in turn located outwardly from central hole 66. Nuts 84 are secured onto external threads of the portions of rear ends 88 that protrude from holes 89 to secure rods 24. Nuts 84 are tightened to clamp sleeve 21 with the desired amount of force between nose cone 22 and end plate 26. A front end portion of sleeve 21 is preferably inserted into a rearwardly opening counterbore 90 in nose cone 22 to prevent misalignment. Counterbore 90 is spaced inwardly a slight distance from rod mounting holes 87, as shown in FIGS. 4 and 9.

In this manner, tie rods 24 extend along the length of sleeve 21 spaced a slight distance therefrom. To reduce noise due to vibrations, tie rods 24 can be provided with elastomeric sleeves (not shown) that are interposed between tie rods 24 and sleeve 21. Each tie rod 24 has a pair of reduced diameter, front and rear end portions 91, 92 that extend rod life by reducing stress on the threaded ends. Cone 22 may further have a frontwardly opening threaded axial hole 93 therein so that to aid in pulling the tool with a cable by first installing a hook or eye in hole 93.

Figure 10:
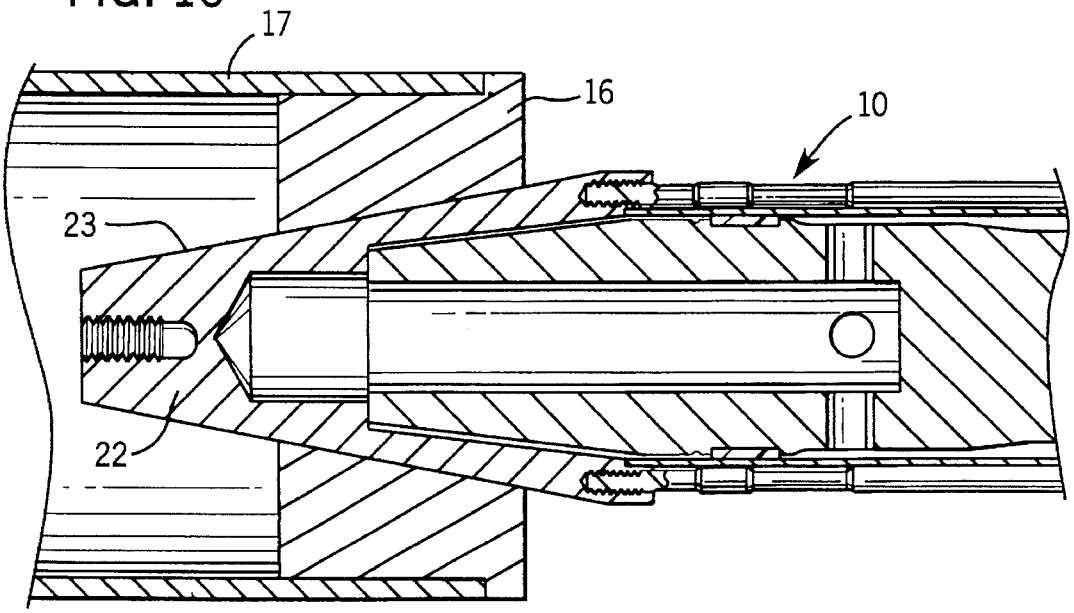
FIG. 10 is a sectional view of the front end of the tool shown in FIG. 1, including a collet and pipe assembly.

Referring to FIG. 10, impact tool 10 of the invention may be used as follows. If needed, a trench is dug in the direction of insertion, and tool 10 is positioned in the far end of the trench. A collet 16 is fitted over nose 22 and positioned in a pipe 17. Pipe 17 is placed in the near end of the trench with its front end in engagement with the trench wall at the installation site. The tool is then operated to pound pipe 17 into the ground end first, As the pipe moves into the ground, the tool follows, moving along towards the near side of the trench.

When pipe 17 has been fully inserted, the tool is operated in reverse by rotation of air hose 53 to displace adjuster screw 54 rearwardly, thereby disengaging tool 10 from the collet 16. Collet 16 is removed from pipe 17. A second section of pipe is then welded to the exposed end of the first pipe, and the collet and tool are reinserted into the far end of the second pipe section. Adjuster screw 54 is displaced to its forward mode position once more, and the process is then repeated as many times as needed to complete the run.

Once the end of the first pipe has emerged at the target site at the end of the run, tool 10 and collet 16 are removed from the trench, and one end of the pipe is capped with a fitting including a high pressure nozzle. Soil inside the pipe is then removed by first flooding the interior of the pipe with water through the nozzle and then forcing the soil out using compressed air in a manner well known in the art.

When the tool is operating in reverse mode, tie rods 24 are sufficiently rigid to permit the tool to pass the energy of impact therethrough to move the tool in reverse. If cables or chains are used as the tying devices instead of rigid rods, reverse movement of the tool would be difficult or impossible, hindering release from the collet. In such a case, it would likely be necessary to use a releasable collet, or provide a non-tapered nose cone configured for pipe pushing with the tie rods connecting the adapter cone directly to the end cap.

Figure 11:
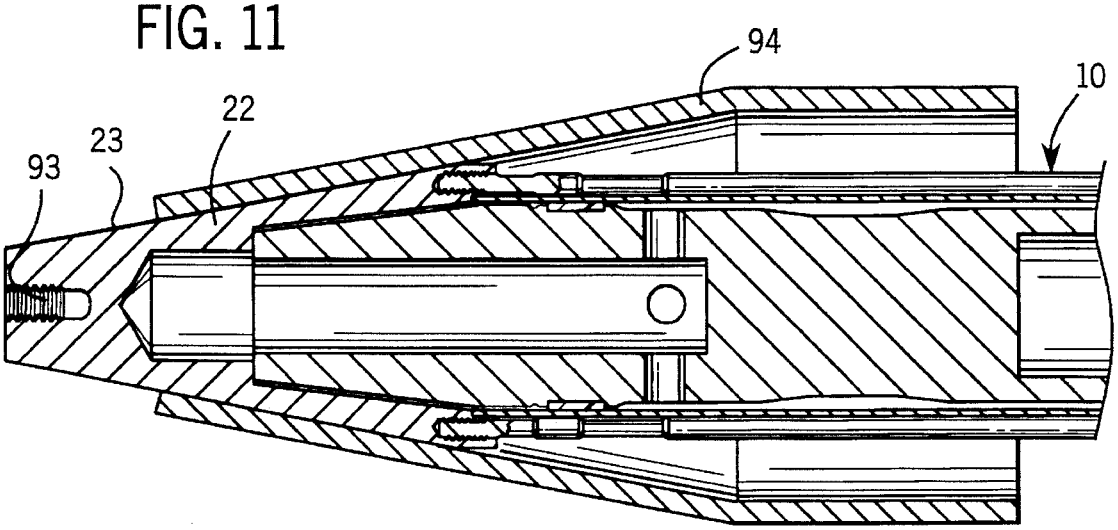
FIG. 11 shows the tool of FIG. 1 provided with an expander.

Tool 10 according to the invention can also be used in a manner similar to conventional pneumatic earth piercing tools. As shown in FIG. 11, this is best done by mounting a conventional removable expander 94 over tapered surface 23 of nose cone 22. Either a full- or part-length expander may be used. The outer surface of expander 94 engages the soil so that the tool can move in forward or reverse mode in the same manner as a conventional piercing tool.

The tool of the invention provides a number of advantages over conventional pneumatic impact ground-piercing tools of the type shown in Wentworth U.S. Pat. No. 5,025,868. The nose section can be easily replaced, making it possible to use different heads for ramming and pipe cracking operations. Manufacture is simplified because the small diameter tie rods can be more easily machined than a large tool body. Further, since the tie rods transmit the impacts to accelerate the body forward, the sleeve clamped between the nose section and the end cap can be thin and made of ordinary steel (rather than an alloy), providing a very light body assembly.

It will be understood that the foregoing description is of preferred exemplary embodiments of the invention, and that the invention is not limited to the specific forms shown. For example, tie rods 24 could be secured by any mechanical means capable of locking rods 24 in place with suitable clamping force, such as a latch mechanism, and could be integrally formed with either one of the nose section or end cap. These and other modifications may be made in the design and arrangement of the elements without departing from the scope of the invention as expressed in the appended claims.

I claim:

1. A pneumatic impact tool, comprising:

a body including a sleeve, a nose section fitted over a front end of the sleeve, an end cap in engagement with a rear end of the sleeve, and a tie rod secured to the nose section and end cap for clamping the sleeve therebetween;

a striker disposed for reciprocation within the body to impart impacts to the nose section for driving the body forward;

an air distributing mechanism for effecting reciprocation of the striker; and a tail assembly mounted in a rear end opening of the body that secures the striker and air distributing mechanism in the body, the tail assembly including a tail nut having an outer flange that is rigidly clamped between a rear end of the sleeve and the end cap to secure the tail nut to the body.

2. The tool of claim 1, wherein the tying device comprises a number of rigid tie rods spaced outwardly from the sleeve and extending in parallel therewith, and means for securing opposite end portions of the tie rods to the nose section and end cap.

3. The tool of claim 2, wherein the tie rods have front and rear threaded ends, the front threaded ends being secured in threaded, rearwardly facing holes in the nose section disposed outwardly from the sleeve, and which rear threaded ends extend through aligned mounting holes in the end cap, further comprising nuts mounted on the rear threaded ends for securing each tie rod, which nuts are tightened against a rear face of the end cap.

4. The tool of claim 3, wherein the end cap comprises a plate having the mounting holes formed therethrough about a central opening through which an air supply hose extends, which air supply hose is connected to the air distributing mechanism.

5. The tool of claim 1, wherein the nose section has a rearwardly opening counterbore which closely receives a front end portion of the sleeve therein.

6. The tool of claim 1, wherein the nose section comprises a nose cone having a frontwardly tapering outer surface configured for engagement with a collet.

7. The tool of claim 1, further including a reversing mechanism for causing rearward impacts of the striker against an impact surface of the air distributing mechanism.

8. A pneumatic impact tool, comprising:

a body including a sleeve, a nose section fitted over a front end of the sleeve, an end cap in engagement with a rear end of the sleeve, and a tying device engaging the nose section and end cap for clamping the sleeve therebetween;

a striker disposed for reciprocation within an internal chamber of the sleeve to impart impacts to the nose section for driving the body forward, the striker having a rearwardly opening recess and a rear radial passage through a wall enclosing the recess, a front end portion having a bearing thereon for sliding engagement with the internal chamber and passages permitting flow of pressure fluid to a front, variable-volume pressure chamber ahead of the striker, and a rear end portion having a bearing thereon rearwardly of the radial passage for sliding engagement with the internal chamber;

an air distributing mechanism for effecting reciprocation of the striker, the air distributing mechanism including a stepped air inlet conduit which cooperates with the striker within the internal chamber of the body to impart blows to a front end wall of the internal chamber under the action of a pressure fluid fed into the rear opening in the striker, followed by reverse movement of the striker upon passage of the rear radial passage past a front edge of a step of the stepped air inlet conduit, and exhaust of compressed air upon passage of the rear radial passage past a rear edge of the step of the stepped air inlet conduit; and a tail assembly mounted in a rear end opening of the body that secures the striker and air distributing mechanism in the body, the tail assembly including a tail nut having an outer flange that is rigidly clamped between a rear end of the sleeve and the end cap to secure the tail nut to the body, the tail nut having a central lengthwise opening extending therethrough in which the air inlet conduit is mounted and having exhaust passages for exhaust of compressed air.

9. The tool of claim 8, wherein the tying device comprises a number of rigid tie rods spaced outwardly from the sleeve and extending in parallel therewith, and means for securing opposite end portions of the tie rods to the nose section and end cap.

10. The tool of claim 9, wherein the tie rods have front and rear threaded ends, the front threaded ends being secured in threaded, rearwardly facing holes in the nose section disposed outwardly from the sleeve, and which rear threaded ends extend through aligned mounting holes in the end cap, further comprising nuts mounted on the rear threaded ends for securing each tie rod, which nuts are tightened against a rear face of the end cap.

11. The tool of claim 10, wherein the end cap comprises a plate having the mounting holes formed therethrough about a central opening through which an air supply hose extends, which air supply hose is connected to the air distributing mechanism, and further having exhaust holes therethrough in alignment with the exhaust passages in the tail nut.

12. The tool of claim 8, further comprising a reversing mechanism including interior threads on the central lengthwise opening of the tail nut and exterior threads on the air inlet conduit in engagement therewith so that the air inlet conduit can be moved in a lengthwise direction of the tool by rotating the air inlet conduit.

* * * * *